US005522320A

United States Patent [19]

Dillehay

[11] Patent Number: 5,522,320

[45] Date of Patent: Jun. 4, 1996

[54] LOW-TOXICITY OBSCURING SMOKE FORMULATION

[75] Inventor: David R. Dillehay, Marshall, Tex.

[73] Assignee: Thiokol Corporation, Ogden, Utah

[21] Appl. No.: 90,768

[22] Filed: Jul. 12, 1993

[51] Int. Cl.[6] ..... F42B 13/44

[52] U.S. Cl. ..... 102/334; 102/513; 149/117

[58] Field of Search ..... 149/117; 102/334, 102/513

[56] References Cited

U.S. PATENT DOCUMENTS

| | | | |
|---|---|---|---|
| H233 | 3/1987 | Tracy | 149/117 |
| 3,607,472 | 9/1971 | Douda | 149/19 |
| 3,650,856 | 3/1972 | Artz | 149/19.9 |
| 3,884,734 | 5/1975 | Palmer et al. | 149/6 |
| 4,032,374 | 6/1977 | Douda et al. | 149/19.8 |
| 4,238,254 | 12/1980 | Prähauser et al. | 149/29 |
| 4,291,629 | 9/1981 | Kezer | 102/334 |
| 4,391,197 | 7/1983 | Jacobsen et al. | 102/334 |
| 4,436,034 | 3/1984 | Jacobsen et al. | 102/334 |
| 4,534,810 | 8/1985 | Knapp | 149/29 |
| 4,622,899 | 11/1986 | Weber | 102/334 |
| 4,697,521 | 10/1987 | Espagnacq et al. | 102/334 |
| 4,841,865 | 6/1989 | Liberman | 102/334 |
| 5,154,782 | 10/1992 | Shaw et al. | 149/19.5 |
| 5,180,452 | 1/1993 | Lund et al. | 149/19.9 |
| 5,337,671 | 8/1994 | Varme | 102/334 |

*Primary Examiner*—Edward A. Miller

*Attorney, Agent, or Firm*—Ronald L. Lyons; Madson & Metcalf

[57] ABSTRACT

Smoke-producing compositions are disclosed that combine the low toxicity of an organic acid smoke and the high obscuration effect of a red phosphorus (RP) smoke. Phosphoric acid produced by RP is neutralized by an acid scavenger added to at least one of the RP or organic acid smoke formulations. To prevent chemical reaction between ingredients of the two smoke-producing formulations, they are separated in the apparatus of the present invention such that only the resulting smokes mix. Very small amount of a RP smoke formulation increases the obscuration index of organic acid smokes comparable to conventional hygroscopic chloride (HC) smokes.

28 Claims, 2 Drawing Sheets

LOW-TOXICITY OBSCURING SMOKE FORMULATION

BACKGROUND OF THE INVENTION

1. Field of the Invention

This invention relates to smoke and obscurant pyrotechnic compositions. More specifically, the present invention relates to low toxicity smoke-producing compositions that have an obscuration index at least as great as hygroscopic chloride (HC) smoke.

2. Technology Background

Prior art and experimentation teach that obscuration efficiency is a function of particulate size, refractive index and concentration in the atmosphere. Conventional pyrotechnic obscurant compositions are, therefore, based on materials which generate a dense primary particulate, such as inorganic oxides, or compounds which easily form atmospheric aerosols, such as hydrochloric acid, polyphosphates, or phosphoric acid.

Although various smoke-producing compositions and devices are presently known, many such compositions are toxic. Most smoke-producing compositions incorporate materials which are severely toxic or are irritants when subjected to the heat necessary to produce smoke. Personnel anticipating exposure to such harmful smoke must protect themselves from the smoke. The problem of toxicity and irritation to people is clearly a limitation in several respects. Not only does it increase the potential for injury, but it may dictate the use of additional specialized equipment, such a respiratory protection. This type of equipment is expensive, and in the situations such as training exercises, may detract from the ability to simulate actual conditions.

A related problem is the effect of smoke-producing compositions on equipment and supplies. In addition to being toxic and irritating to people, conventional smoke-producing compositions are corrosive and damaging to both mechanical and electronic equipment. It will be appreciated that this is a major disadvantage under typical operating conditions. Smoke producers are usually employed in field operations which involve the use of precision electronic and mechanical equipment that may be damaged by the corrosive exhaust of such smoke-producing agents. Accordingly, the use of corrosive and damaging chemical compositions is a severe limitation for many known smoke compositions.

For military use, volatile hygroscopic chloride (HC) smokes are important for large scale operations. The most widely used HC type smoke-producing compositions are those resulting in the production of zinc chloride smokes. One example of a military HC smoke composition employs a reaction between hexachloroethane and zinc to produce zinc chloride. However, the reaction products are very toxic and believed to be carcinogenic. This has recently prompting the United States Surgeon General to ban the use of such smokes. Typical HC smokes have an obscuration index of about 200.

Obscuration index is a dimensionless figure of merit for comparing the efficacy of smoke compositions. It compares the transmittance of electromagnetic radiation of a wavelength (or band of wavelengths) at a fixed smoke concentration and pathlength. The following equation, based upon Beer's Law, defines the transmittance of a smoke cloud as a function of mass extinction coefficient, concentration and path length. The transmittance is a function of both wavelength and time in a burning pyrotechnic.

$$T_\lambda(t)=e^{-\alpha CL}$$

where T=transmittance at some wavelength, $\lambda$ $\alpha$=extinction coefficient in $m^2/g$, C=smoke concentration in $g/m^3$, and L=path length in m.

Other effective smoke-producing compositions are based on phosphorus compounds (particularly red phosphorus) which form phosphoric acid in the atmosphere. Typical red phosphorus (RP) smokes have an obscuration index of about 4000. Although phosphorus smokes are highly effective, the smoke products are extreme irritants and are corrosive. This has led the United States Surgeon General to require the use of gas masks by persons exposed to such smokes. In addition, phosphorus reactions typically produce intense heat which is a further hazard and limitation of this type of material.

There have been recent efforts to develop low toxicity smoke compositions based upon organic acids. For example, Douda et al. U.S. Pat. No. 4,032,374 discloses a low toxicity smoke composition based upon cinnamic acid for simulating fires and for training purposes. The cinnamic acid is volatilized by burning a mixture of potassium chlorate and sugar. Other low toxicity obscuring smokes based on aliphatic diacids are disclosed in Shaw et al. U.S. Pat. No. 5,154,782, which is incorporated herein by reference. In general, low toxicity smoke compositions based on organic acids have an obscuration index from about 120 to 140, approximately 60% of the screening power of HC smoke.

It will be appreciated that current low toxicity smokes are useful for training purposes, but not for battlefield deployment. This requires the military agency to maintain a training round and a field use round of smoke-producing compositions. It would be a significant advancement in the art to provide low toxicity smoke generating compositions that can be used for both training and field deployment. Reduced inventory costs and ability to train troops in the same smoke environment that would be encountered on the battlefield would be an important advantage.

Such low toxicity smoke generating compositions are disclosed and claimed herein.

SUMMARY OF THE INVENTION

The present invention provides a smoke generation composition that combines the low toxicity of an organic acid smoke and the high obscuration effect of a red phosphorus (RP) smoke. The apparatus of the present invention includes separate compartments for a conventional RP smoke formulation and an organic acid smoke formulation. An acid scavenger is included in either or both of the RP or organic acid smoke formulations to neutralize phosphoric acid produced by RP. The high obscuration index of RP smoke allows the use of a very small amount of a RP smoke formulation to increase the obscuration index of organic acid smokes from 60% of HC smoke to 100% or 125% of HC smoke. The low level of phosphoric acid produced is readily neutralized by the acid scavenger. Preferred acid scavengers include metals which form metal oxides capable of neutralizing the phosphoric acid produced by the red phosphorus. The resulting metal phosphates are believed to be environmentally compatible. Lithium, sodium, potassium, calcium, strontium, and magnesium are examples of compounds capable of forming acid scavengers.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE INVENTION

The present invention provides a smoke generation composition that combines the low toxicity of an organic acid smoke and the high obscuration effect of a red phosphorus (RP) smoke. Phosphoric acid produced by RP is neutralized by adding an acid scavenger to either or both of the RP or organic acid smoke formulations. Since RP reacts strongly with the potassium chlorate commonly used with organic acid smokes, the present invention keeps the two smoke-producing compositions separate and only lets the resulting smokes mix.

Figure 1:
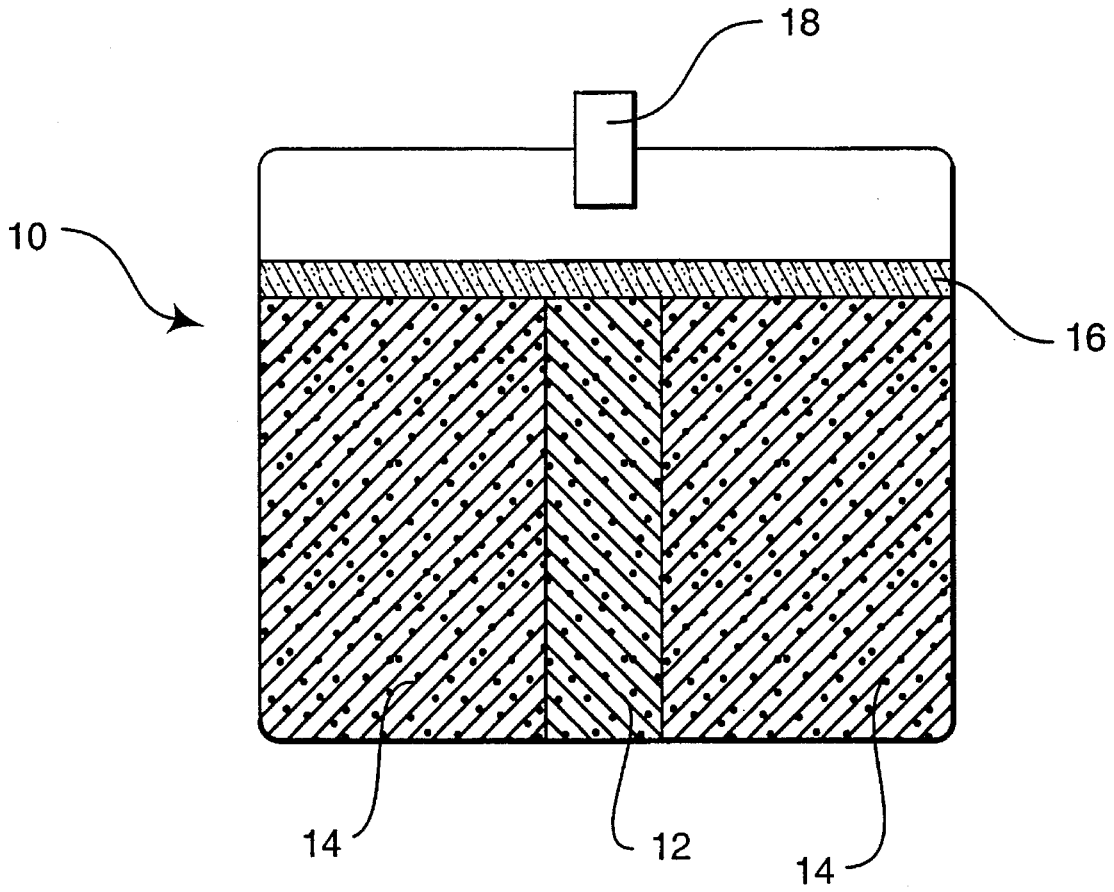
FIG. 1 is a cross-sectional representation of a smoke pot according to the present invention containing a red phosphorus-based smoke formulation separated from an organic acid-based smoke formulation.
Figure 2:
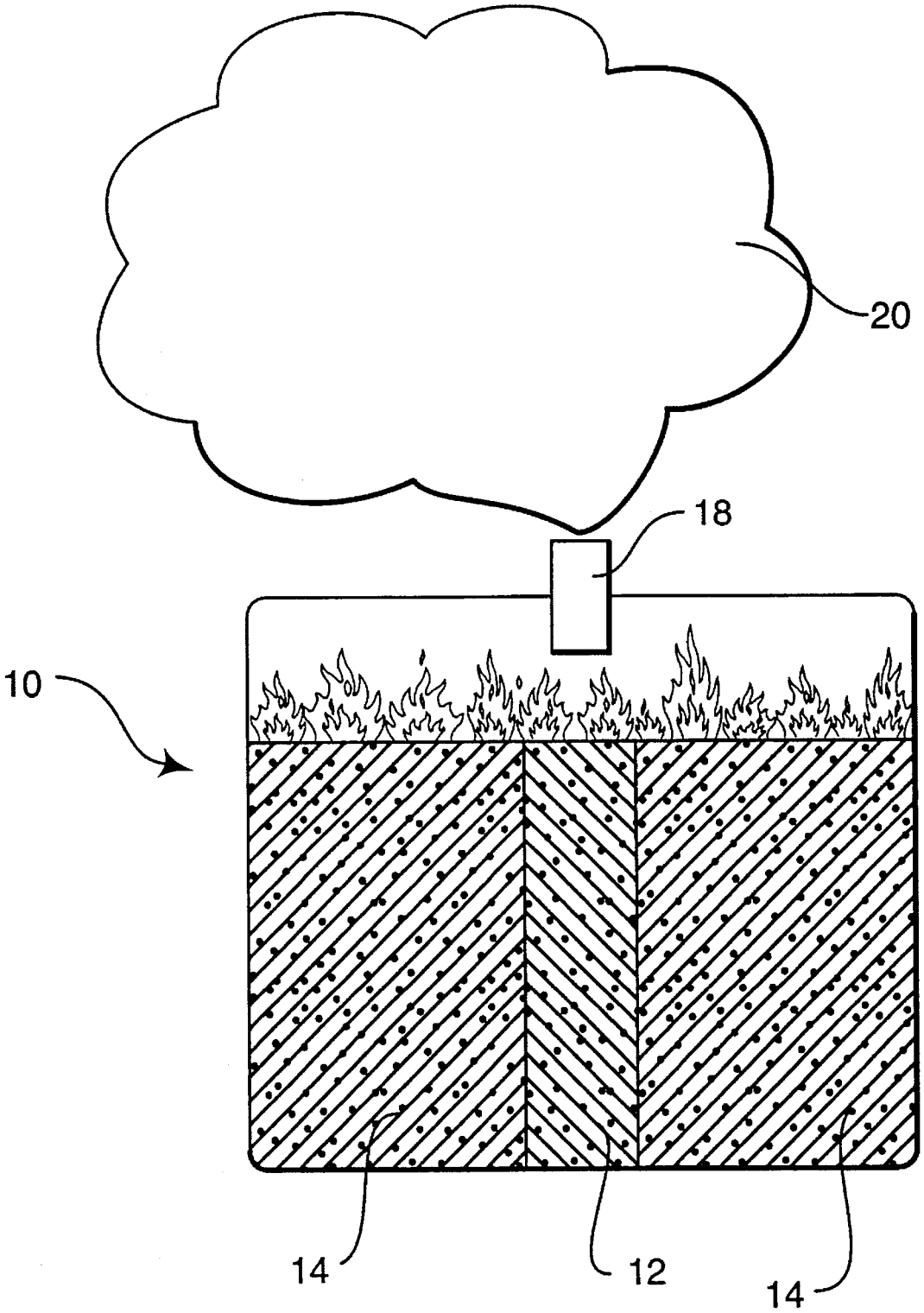
FIG. 2 is a cross-sectional representation of the smoke pot of FIG. 1 in operation showing the smoke produced by the red phosphorus and the organic acid smoke formulations exiting the smoke pot as a mixed smoke cloud.

A currently preferred apparatus of the present invention is a conventional smoke pot device in which the RP smoke formulation is pressed or cast into a separate compartment than the organic acid smoke formulation. As illustrated in FIG. 1, a smoke pot device 10 contains a center canister 12 into which a RP smoke-producing formulation is placed. A cavity 14 around the RP canister 12 contains the organic acid smoke formulation. A conventional igniter 16 is used to ignite both smoke formulations. As shown in FIG. 2, the ignited smoke formulations produce two smokes which mix and are ejected into the atmosphere through exit vent 18 as a mixed smoke cloud 20.

One or more acid scavengers present in the smoke products react with phosphoric acid to produce neutral phosphates. Since phosphates are often applied to fields as fertilizer, it is believed the phosphate products should be environmentally acceptable.

The high obscuration index of RP smoke allows the use of a very small amount of a RP smoke formulation to increase the obscuration index of organic acid smokes from 60% of HC smoke to 100% or 125% of HC smoke. The low level of phosphoric acid produced is readily neutralized. The amount of RP smoke-producing formulation is preferably held to the minimum level necessary to produce the desired obscuration index. In typical compositions of the present invention having an obscuration index comparable to HC smokes, the RP will be represent from about 10% to about 25% by weight.

A typical RP-based smoke-producing formulation is shown below:

| Material | Weight % |
|---|---|
| red phosphorus | 45–60 |
| oxidizer | 15–50 |
| acid scavenger | 0–15 |
| binder | 5–10 |

The oxidizer used with RP is preferably selected such that the resulting smoke-producing composition is not sensitized. Manganese dioxide is a very safe oxidizer for use with RP. Pyrolusite, a naturally occurring manganese dioxide ore, is a currently preferred oxidizer for the RP.

The acid scavenger is preferably a compound which forms an acid scavenger upon being volatilized. For example, certain metals form oxides which can neutralize the phosphoric acid produced by the red phosphorus by forming metal phosphates. Sodium and potassium are two examples of possible acid scavengers. Other metals which may act as acid scavengers include lithium, calcium, strontium, and magnesium. Other metals such as beryllium, rubidium, and cesium would also be expected to function as acid scavengers, but they are not practical from cost or toxicity considerations.

Various binders known to those skilled in the art may be used in the RP formulations of the present invention. The binder is preferably present in the range from about 5% to 10% by weight, although those skilled in the art will appreciate that other binder amounts may be used depending on the desired physical characteristics of the final smoke composition. One currently preferred binder which may be used is Viton A®, a fluorinated ethylene propylene copolymer sold by DuPont. It has a high density and is somewhat energetic.

A typical organic acid-based smoke-producing formulation is shown below:

| Material | Weight % |
|---|---|
| organic acid | 35–75 |
| oxidizer | 10–35 |
| low energy fuel | 5–30 |
| acid scavenger | 0–15 |
| binder | 5–10 |

The organic acid is preferably selected from known or novel organic acids which form smoke clouds upon being volatilized. Examples of suitable organic acids include salicylic acid, cinnamic acid, terephthalic acid, phthalic acid, vanillic acid, naphthenoic acid, adipic acid, pimelic acid, suberic acid, and sebacic acid.

The organic acid smoke-producing formulations of the present invention also incorporate at least one binder for providing the desired consistency and cured physical characteristics. The organic acid smoke formulations used in the present invention may be formulated to be castable or pressable.

Numerous binders are known and used in the art which may be included in the smoke-producing formulations of the present invention. However, specific binders which have been found to have acceptable characteristics include aliphatic polyester ethers, and polyether-sulfide polymers. In certain applications, nitrocellulose is specifically desirable because it results in a decreased solid residue within the burned smoke pot or grain.

Binders of these types, in addition to providing desirable binding characteristics, produce a low energy output upon combustion. This is important in avoiding very high energy outputs, high temperatures, and flames which render smoke-producing compositions dangerous and difficult to handle.

The organic acid smoke formulations used in the present invention also include one or more oxidizer compounds. It is found that potassium chlorate ($KClO_3$) is an efficient oxidizer and produces good results when coupled with the organic acid smoke-producing species.

In certain embodiments the organic acid formulations of the present invention include an additional fuel. As with the binder, the fuel is preferably a relatively low energy fuel, and may in fact act as a coolant. It is also preferred that the fuel produce gaseous species which are capable of carrying the smoke-producing agent into the atmosphere. Some fuels which are found to be acceptable include starch, dextrose, polyhydroxylic compounds such as lactose, sucrose, and sulfur. It will be appreciated that in some of the preferred embodiments, the binder compositions are capable of serving the function of the low energy fuel so that no additional fuel need be added.

Certain other materials may also be added to produce specific desired results. For example, carbonate and bicarbonate salts may be added to the organic acid formulation in the range from about 1% to about 20% to act as a buffer and to prevent auto catalytic decomposition of the oxidizer. The carbonate and bicarbonate salts also function as a coolant when the composition is combusted. Examples of possible carbonate and bicarbonate salts which may be used in the present invention include $K_2CO_3$, $KHCO_3$, $MgCO_3$, $Na_2CO_3$, or $NaHCO_3$, with sodium bicarbonate being particularly preferred. Advantageously, the counterion metal, K, Mg, or Na, may form oxides which are capable of neutralizing phosphoric acid produced by the RP smoke formulation.

Another additive which may be added to the organic acid formulation is aluminum. In some cases, atomized aluminum may provide additional thermal conductivity within the smoke formulation. This results in more uniform heat transfer and ignition of the fuel. Aluminum in the range from about 2% to about 5% is presently preferred.

Those skilled in the art will appreciate that the smoke concentration in the atmosphere is directly related to the burn rate of the smoke-producing formulation. Thus, the faster the burn rate, the greater the smoke concentration. In practice, the choice of pyrotechnic vehicle, i.e., the oxidizer, binder, fuel, and other related ingredients in the smoke-producing formulations of the present invention, are selected to have a burn rate sufficient to produce a smoke cloud having a desired atmospheric concentration. The pyrotechnic vehicle should also generate sufficient heat volatilize the RP or organic acid and produce the desired smoke.

The following examples are offered to further illustrate the present invention. These examples are intended to be purely exemplary and should not be viewed as a limitation on any claimed embodiment.

EXAMPLE 1

A pyrotechnic composition that generates an obscuring smoke cloud upon heating is prepared by casting a red phosphorus smoke formulation into a separate canister located in the center of a smoke pot. The red phosphorus (RP) smoke formulation is as follows:

| Material | Wt. % |
|---|---|
| Red phosphorus | 55 |
| Pyrolusite | 25 |
| Magnesium | 15 |
| Viton ® A | 5 |

An organic acid smoke formulation is cast in the cavity around the RP canister. The organic acid smoke formulation is as follows:

| Material | Wt. % |
|---|---|
| Sebacic acid | 40 |
| Nitrocellulose | 10 |
| Lactose | 10 |
| $KClO_3$ | 35 |
| Aluminum | 5 |

The RP smoke formulation represents about 20% of the total pyrotechnic composition, by weight. The manganese dioxide (from the pyrolusite), magnesium oxide (formed by combustion of the magnesium), and potassium oxide (from the potassium chlorate) smoke products are capable of neutralizing the phosphoric acid produced by the RP. When ignited, this composition is expected to produce a cloud of obscuring, low toxicity smoke having an obscuration index of about 225.

EXAMPLE 2

A pyrotechnic composition that generates an obscuring smoke cloud upon heating is prepared according to Example 1, except that the organic acid smoke formulation is as follows:

| Material | Wt. % |
|---|---|
| Cinnamic acid | 45 |
| Nitrocellulose | 10 |
| Sucrose | 10 |
| $KClO_3$ | 30 |
| $NaHCO_3$ | 5 |

The RP smoke formulation represents about 20% of the total pyrotechnic composition, by weight. When ignited, this composition is expected to produce a cloud of obscuring, low toxicity smoke having an obscuration index of about 250.

EXAMPLE 3

A pyrotechnic composition that generates an obscuring smoke cloud upon heating is prepared according to Example 1, except that the organic acid smoke formulation is as follows:

| Material | Wt. % |
|---|---|
| Terephthalic acid | 50 |
| Nitrocellulose | 8 |
| Sucrose | 10 |
| $KClO_3$ | 27 |
| $NaHCO_3$ | 5 |

The RP smoke formulation represents about 20% of the total pyrotechnic composition, by weight. When ignited, this composition is expected to produce a cloud of obscuring, low toxicity smoke having an obscuration index of about 250.

EXAMPLE 4

A pyrotechnic composition that generates an obscuring smoke cloud upon heating is prepared by casting a red phosphorus smoke formulation into a separate canister located in the center of a smoke pot. The red phosphorus (RP) smoke formulation is as follows:

| Material | Wt. % |
|---|---|
| Red phosphorus | 55 |
| Sodium Nitrate | 35 |
| LP/epoxy binder | 5 |

An organic acid smoke formulation is cast in the cavity around the RP canister. The organic acid smoke formulation is as follows:

| Material | Wt. % |
|---|---|
| Sebacic acid | 40 |
| Nitrocellulose | 10 |
| Lactose | 10 |
| $KClO_3$ | 35 |
| Aluminum | 5 |

The RP smoke formulation represents about 20% of the total pyrotechnic composition, by weight. The manganese dioxide (from the pyrolusite), magnesium oxide (formed by combustion of the magnesium), and potassium oxide (from the potassium chlorate) smoke products are capable of neutralizing the phosphoric acid produced by the RP. When ignited, this composition is expected to produce a cloud of obscuring, low toxicity smoke having an obscuration index of about 225.

EXAMPLE 5

A pyrotechnic composition that generates an obscuring smoke cloud upon heating is prepared according to Example 4, except that the organic acid smoke formulation is as follows:

| Material | Wt. % |
|---|---|
| Cinnamic acid | 45 |
| Nitrocellulose | 10 |
| Sucrose | 10 |
| $KClO_3$ | 30 |
| $NaHCO_3$ | 5 |

The RP smoke formulation represents about 20% of the total pyrotechnic composition, by weight. When ignited, this composition is expected to produce a cloud of obscuring, low toxicity smoke having an obscuration index of about 250.

EXAMPLE 6

A pyrotechnic composition that generates an obscuring smoke cloud upon heating is prepared according to Example 4, except that the organic acid smoke formulation is as follows:

| Material | Wt. % |
|---|---|
| Terephthalic acid | 50 |
| Nitrocellulose | 8 |
| Sucrose | 10 |

-continued

| Material | Wt. % |
|---|---|
| $KClO_3$ | 27 |
| $NaHCO_3$ | 5 |

The RP smoke formulation represents about 20% of the total pyrotechnic composition, by weight. When ignited, this composition is expected to produce a cloud of obscuring, low toxicity smoke having an obscuration index of about 250.

From the forgoing, it will be appreciated that the present invention provides smoke generating compositions that combine the high obscuration index of RP smoke formulations with the low toxicity of organic acid smoke formulations such that the resulting smoke has a sufficiently high obscuration index that it can be used for both training and field deployment.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A pyrotechnic device that generates an obscuring smoke cloud upon burning, comprising:

a phosphorus-based smoke-producing formulation comprising red phosphorus, an oxidizer, and a binder; and an organic acid-based smoke-producing formulation comprising an organic acid capable of forming a smoke upon being volatilized, an oxidizer, and a binder, wherein the phosphorus-based smoke-producing formulation is separated from the organic acid-based smoke-producing formulation such that ingredients of one formulation are not able to chemically react with ingredients of the other formulation during storage of the pyrotechnic device, wherein the device effects simultaneous burning of the phosphorus-based smoke-producing formulation and the organic acid-based smoke-producing formulation, and wherein at least one of the smoke-producing formulations further comprises a metal or metal compound which forms an acid scavenger upon being volatilized and further wherein the red phosphorus-based smoke producing formulation is present from about 10% to about 25%, by weight, of the combined smoke producing formulations in the pyrotechnic device.

2. A pyrotechnic device as defined in claim 1, wherein the metal or metal compound which forms an acid scavenger comprises a metal selected from Na, K, Li, Ca, Sr, and Mg.

3. A pyrotechnic device as defined in claim 1, wherein the metal or metal compound which forms an acid scavenger is magnesium.

4. A pyrotechnic device as defined in claim 1, wherein the oxidizer of the phosphorus-based smoke-producing formulation is manganese dioxide.

5. A pyrotechnic device as defined in claim 1, wherein the oxidizer of the phosphorus-based smoke-producing formulation is pyrolusite.

6. A pyrotechnic device as defined in claim 1, wherein the binder of the phosphorus-based smoke-producing formulation is a fluorinated ethylene propylene copolymer.

7. A pyrotechnic device as defined in claim 1, wherein the organic acid is selected from salicylic acid, cinnamic acid, terephthalic acid, phthalic acid, vanillic acid, naphthenoic acid, adipic acid, pimelic acid, suberic acid, and sebacic acid.

8. A pyrotechnic device as defined in claim 1, wherein the oxidizer of the organic acid-based smoke-producing formulation is potassium chlorate.

9. A pyrotechnic device as defined in claim 1, wherein the oxidizer of the organic acid-based smoke-producing formulation is lithium nitrate.

10. A pyrotechnic device as defined in claim 1, wherein the organic acid-based smoke-producing formulation further comprises a low energy fuel.

11. A pyrotechnic device as defined in claim 10, wherein the low energy fuel is lactose.

12. A pyrotechnic device as defined in claim 1, wherein the organic acid-based smoke-producing formulation further comprises a carbonate or bicarbonate stabilizer.

13. A pyrotechnic device as defined in claim 12, wherein the stabilizer is selected from $K_2CO_3$, $KHCO_3$, $MgCO_3$, $Na_2CO_3$, or $NaHCO_3$.

14. A pyrotechnic device as defined in claim 1, further comprising an igniter for igniting the red phosphorus-based smoke-producing formulation and the organic acid-based smoke-producing formulation.

15. A pyrotechnic device that generates an obscuring smoke cloud upon burning, comprising:

a phosphorus-based smoke-producing formulation comprising:

red phosphorus in the range from about 45% to about 60% by weight;

a metal or metal compound which forms an acid scavenger upon being volatilized in the range from about 0% to 15% by weight;

a binder in the range from about 5% to about 10% by weight; and a oxidizer in the range from about 15% to about 50% by weight;

an organic acid-based smoke-producing formulation comprising:

an organic acid capable of forming a smoke upon being volatilized in the range from about 35% to 75% by weight;

an oxidizer in the range from about 10% to about 35% by weight;

a metal or metal compound which forms an acid scavenger upon being volatilized in the range from about 0% to 15% by weight;

a low energy fuel in the range from about 5% to about 30%; and a binder;

wherein the phosphorus-based smoke-producing formulation is separated from the organic acid-based smoke-producing formulation, wherein the device effects simultaneous burning of the phosphorus-based smoke-producing formulation and the organic acid-based smoke-producing formulation, and wherein at least one of the smoke-producing formulations comprises the metal or metal compound which forms an acid scavenger and further wherein the red phosphorus-based smoke producing formulation is present from about 10% to about 25%, by weight, of the combined smoke producing formulations in the pyrotechnic device.

16. A pyrotechnic device as defined in claim 15, wherein the metal or metal compound which forms an acid scavenger comprises a metal selected from Na, K, Li, Ca, Sr, and Mg.

17. A pyrotechnic device as defined in claim 15, wherein the metal or metal compound which forms an acid scavenger is magnesium.

18. A pyrotechnic device as defined in claim 15, wherein the oxidizer of the phosphorus-based smoke-producing formulation is manganese dioxide.

19. A pyrotechnic device as defined in claim 15, wherein the oxidizer of the phosphorus-based smoke-producing formulation is pyrolusite.

20. A pyrotechnic device as defined in claim 15, wherein the binder of the phosphorus-based smoke-producing formulation is a fluorinated ethylene propylene copolymer.

21. A pyrotechnic device as defined in claim 15, wherein the organic acid is selected from salicylic acid, cinnamic acid, terephthalic acid, phthalic acid, vanillic acid, naphthenoic acid, adipic acid, pimelic acid, suberic acid, and sebacic acid.

22. A pyrotechnic device as defined in claim 15, wherein the oxidizer of the organic acid-based smoke-producing formulation is potassium chlorate.

23. A pyrotechnic device as defined in claim 15, wherein the oxidizer of the organic acid-based smoke-producing formulation is lithium nitrate.

24. A pyrotechnic device as defined in claim 15, wherein the organic acid-based smoke-producing formulation further comprises a low energy fuel.

25. A pyrotechnic device as defined in claim 24, wherein the low energy fuel is lactose.

26. A pyrotechnic device as defined in claim 15, wherein the organic acid-based smoke-producing formulation further comprises a carbonate or bicarbonate stabilizer.

27. A pyrotechnic device as defined in claim 26, wherein the stabilizer is selected from $K_2CO_3$, $KHCO_3$, $MgCO_3$, $Na_2CO_3$, or $NaHCO_3$.

28. A pyrotechnic device as defined in claim 15, further comprising an igniter for igniting the red phosphorus-based smoke-producing formulation and the organic acid-based smoke-producing formulation.

* * * * *